United States Patent [19]

Graham

[11] Patent Number: 4,572,038

[45] Date of Patent: Feb. 25, 1986

[54] MULTI-PURPOSE TOOL

[76] Inventor: Charles H. Graham, 7281 South 3080 East, Salt Lake City, Utah 84121

[21] Appl. No.: 578,365

[22] Filed: Feb. 8, 1984

[51] Int. Cl.[4] ..... B25B 23/00

[52] U.S. Cl. ..... 81/439; 81/490; 81/177.4

[58] Field of Search ..... 7/158, 165; 81/177 E, 81/177 N, 436, 437, 439, 440; 145/62, 63, 64

[56] References Cited

U.S. PATENT DOCUMENTS

| | | | |
|---|---|---|---|
| 438,150 | 10/1890 | Glover | 145/63 |
| 532,823 | 1/1895 | Sanger | 145/63 |
| 1,000,900 | 8/1911 | Dorsey . | |
| 1,345,708 | 7/1920 | Schneider . | |
| 1,816,812 | 8/1931 | Allison . | |
| 2,566,543 | 9/1951 | Weglarz | 81/437 X |
| 2,629,413 | 2/1953 | Stettler | 145/63 |
| 2,635,661 | 4/1953 | Egan | 145/63 |
| 2,679,770 | 6/1954 | Carter et al. | 77/25 |
| 2,714,409 | 8/1955 | Primrose et al. | 145/62 |
| 2,730,145 | 1/1956 | Brown | 145/64 |
| 2,749,953 | 6/1956 | Rundle | 145/63 |
| 2,765,013 | 10/1956 | Pedersen | 145/63 |
| 3,006,395 | 10/1961 | Dye | 145/63 |
| 3,683,984 | 8/1972 | Hull | 145/62 |
| 4,010,663 | 3/1977 | Rydberg | 81/440 |
| 4,227,430 | 10/1980 | Jansson et al. | 81/177 M |
| 4,241,773 | 12/1980 | Personnat | 145/63 |
| 4,273,173 | 6/1981 | Smith et al. | 81/177 M |
| 4,328,721 | 5/1982 | Massari | 81/439 |
| 4,372,362 | 2/1983 | Ahn | 145/63 |
| 4,480,668 | 11/1984 | Lin | 145/63 |

FOREIGN PATENT DOCUMENTS

| | | | |
|---|---|---|---|
| 750138 | 12/1944 | Fed. Rep. of Germany | 145/63 |

*Primary Examiner*—James G. Smith

*Attorney, Agent, or Firm*—Workman, Nydegger & Jensen

[57] ABSTRACT

An apparatus and method for using a multi-purpose tool having a handle with a shaft affixed thereto and a cylinder assembly disposed to longitudinally slide on the shaft between positions in which the shaft is fully extended or fully retracted. While in the fully retracted position, a cylinder having a plurality of chambers housing different tips may be rotated about its axis, which is offset from the shaft, until the desired tip aligns with and engages the shaft in coupling engagement. The shaft is then extended to its fully extended position, thus extending the tip and permitting free rotation of the working tip for use in performing work on a workpiece. Changing the tip requires retracting the shaft, rotating the cylinder to engage the next desired tip, and extending the shaft back to its fully extended position. The multi-purpose tool may be attached to a power tool for power driven rotation.

68 Claims, 8 Drawing Figures

MULTI-PURPOSE TOOL

FIELD OF THE INVENTION

The present invention relates to hand or power tools, and more particularly to a hand or power tool having a plurality of different tips for use in performing work on a workpiece.

BACKGROUND OF THE INVENTION

Various types of hand tools have been known and developed over the years, including such implements as screw drivers, chisels, awls, and the like. These types of implements have become standard instruments in performing specific work tasks such as driving a screw into a workpiece, or chiseling away undesired material. There are occasions, however, in which a workman uses a number of tools in completing a task. For example, a workman may need to alternately use a straight edge screw driver and a Phillips screw driver. In order to address such situations, a number of multi-purpose tools have been developed. Multi-purpose tools not only provide versatility and time savings, but usually save on tool storage space.

Many types of multi-purpose tools have been developed. There are tools in which a plurality of working tips are freely stored within the handle. With these tools, the desired tip is selected and taken from its storage compartment and manually placed in its working position. In most cases, the working tip must be secured in its working position by a spring-loaded detent, a locking screw, or a chuck. To exchange the working tip being used for another working tip, the securing means must be disengaged before the working tip being used may be removed. Once it is removed, a new working tip may be positioned and secured into its working position. If the workman must interchangeably use various working tips, he must repeatedly go through the involved procedure of disengaging the securing means, removing the working tip, replacing the working tip with another working tip, and then engaging again the securing means.

Other types of multi-function tools have avoided the time consuming and frustrating problems created by having a plurality of working tips which must be attached or detached to the tool. Such tools typically position and secure the working tip in its operating position by some mechanical means which is manually operated without manually removing and independently handling the working tip. Tools which fall within this category include those in which the working tip is connected to the tool by a wire support or extension means which permits the working tip to be extracted from its storage compartment and slidably positioned to be secured within a socket. Other such tools include those in which a magazine retains a plurality of working tips within the handle of the instrument. The working tip is removed from its storage position into its working position in a number of ways. Some tools position the working tip over a stationary chute which directs the working tip into its operating position. Once the working tip is disposed over the chute, the tip is released and under the force of gravity it drops into its operating position where it is appropriately secured. Other such tools have a stationary magazine and a movable chute in which the chute is positioned under the desired working tool before such tool is released to drop into its working position. Still another of such tools has a rotating magazine in which the working tip is captured by a sliding button assembly which may be slidably moved to position the working tip for use.

Frequently, the mechanisms used to secure the working tip are delicate and particularly susceptible to breakage under a large torque force because the mechanisms bear a large portion of the force. This makes such multi-purpose tools particularly unsuitable for connection with a power source such as a power drill. Also, due to such forces, the mechanisms sometimes bind making it difficult to exchange working tools or strip which may render the tool virtually useless.

Illustrative of the various types of multi-purpose hand tools are U.S. Pat. Nos. 4,273,173; 4,241,773; 4,227,430; 4,010,663; 3,683,984; 2,749,953; 2,635,661; 2,629,413; 532,523; and 438,150.

Although there have been a number of developments in multi-purpose tools, it would be an improvement to provide a multi-purpose tool in which the working tips may be interchanged simply and rapidly without having to remove the working tips from the tool and without reliance upon gravity to position the tool. It would also be an advantage to provide a multi-purpose hand tool without a securing screw, chuck or the like in which the working tip may rotate freely independent of the magazine which houses such tip when it is not in its working position. It would further be an advantage to provide a sturdy multi-purpose tool which can be attached to and used in connection with a power tool.

OBJECTS AND BRIEF SUMMARY OF THE INVENTION

In view of the foregoing needs and problems experienced by workmen which make multi-purpose tools desirable, it is a primary object of the present invention to provide an improved multi-purpose tool that can interchangeably provide a plurality of working tips in rapid succession.

It is another object of the present invention to provide a multi-purpose tool in which no securing screw, chuck or the like is required to hold the working tip in position and/or bear the torque force incident to using such a tool.

A further object of the present invention is to provide a multi-purpose tool in which a working tip, upon being selected for use is positively coupled to a sturdy shaft and pressed into its working position wherein the shaft supports the working tip against head-on, as well as torque forces.

Yet another object of the present invention is to provide a multi-purpose tool in which the handle, shaft, and working tip are capable of rotating freely and independently of the assembly which houses the tips such that the assembly can serve as a grip for positioning the working tip and stabilizing the tool during use.

Still another object of the present invention is to provide an attractive multi-purpose tool which requires a minimum of storage space while providing the capability of performing a plurality of functions.

A further object of the present invention is to provide a sturdy multi-purpose tool adapted for attachment to and use in connection with a power tool.

These and other objects and features of the present invention will become more fully apparent from the following description and appended claims taken in conjunction with the accompanying drawings.

The foregoing objects are accomplished by the multi-purpose tool of the present invention which comprises a handle, a shaft having one end firmly attached to the handle and a distal end extending outwardly from the handle, a cylinder assembly which slidably engages the shaft, a plurality of working tips stored in the cylinder assembly, and a means for selecting and coupling any of the working tips to the distal end of the shaft. The cylinder assembly has a rear barrel portion having a bore which slidably receives the shaft in a longitudinal sliding engagement, a forward barrel portion also having a bore aligned with the bore of the rear barrel portion, and a cylinder rotatably disposed between the rear and forward barrels. The cylinder has a plurality of chambers in which the various tips are stored when not in use. Further, the cylinder has an axis of rotation which is offset from and substantially parallel to the longitudinal axis of the shaft such that as the cylinder is rotated about its axis, each chamber, in turn, aligns itself with the bores of the rear and forward barrel portions of the cylinder assembly. When so aligned, the shaft engages the working tip within the aligned chamber in coupling engagement. The shaft may then be extended into the chamber thereby pushing the working tip or tool from its stored position in the chamber into the bore of the forward barrel portion of the cylinder assembly, and then into its working position protruding from the forward barrel portion.

When the shaft is fully extended it is free to rotate independent of the cylinder assembly. Thus, the torque or rotational forces that are applied to the handle are transmitted to the working tip to perform the desired work on the workpiece.

The cylinder assembly is secured in its position wherein the shaft is fully extended by a sleeve and catch mechanism that may be push-button released. Once the cylinder assembly is released, it may slide longitudinally on the shaft to the position where the shaft is fully retracted and another working tool may be selected.

When the shaft is fully retracted into the bore of the rear barrel portion of the cylinder assembly, the cylinder may be rotated in order to select the next tip. The cylinder is again rotated until the chamber holding the next desired tip is in alignment and is coupled with the end of the shaft. The coupling is accomplished by a tongue-in-groove arrangement in which the end of the shaft captures a connecting end of the working tip when it is properly aligned with the shaft. The selected tip is then positioned in its working position by again extending the shaft through the chamber and into the bore of the forward barrel portion of the cylinder assembly, as described above.

A power driven embodiment of the multi-purpose tool of the present invention has a shaft which extends beyond the handle. The end of the shaft is adapted for attachment to a power tool such as a power drill or power screw driver.

BRIEF DESCRIPTION OF THE DRAWINGS

For a more complete understanding of this invention, reference should now be made to the embodiments illustrated in greater detail in the accompanying drawings and described below. In the drawings.

DETAILED DESCRIPTION OF THE PREFERRED EMBODIMENTS

Figure 1:
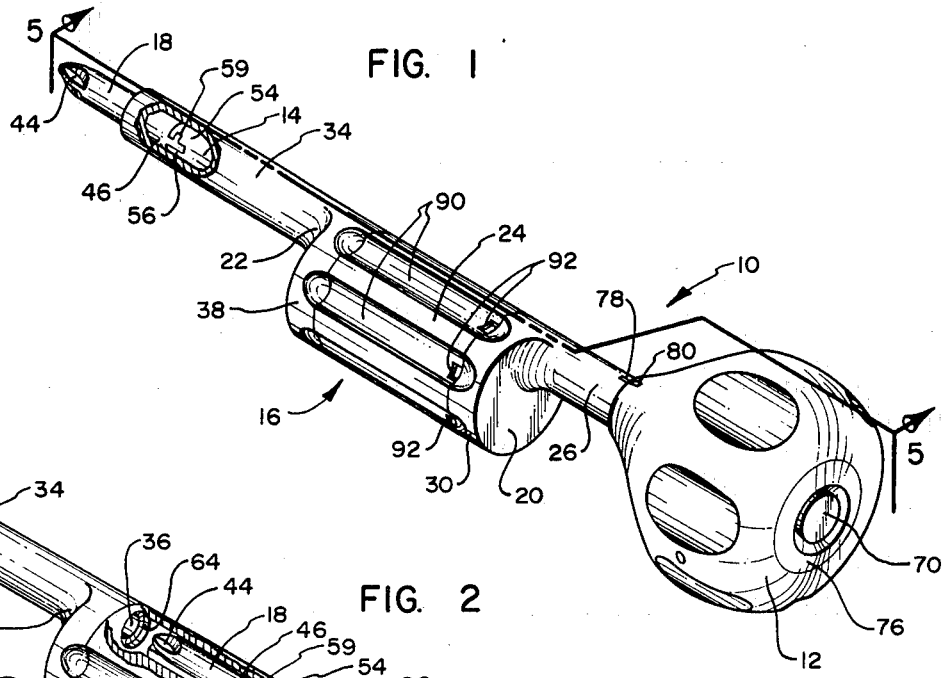
FIG. 1 is a perspective view of one presently preferred embodiment of this invention wherein the shaft is in its fully extended position and a portion of the forward barrel of the cylinder assembly is cut away to reveal the coupling of the shaft to the selected tip.
Figure 2:
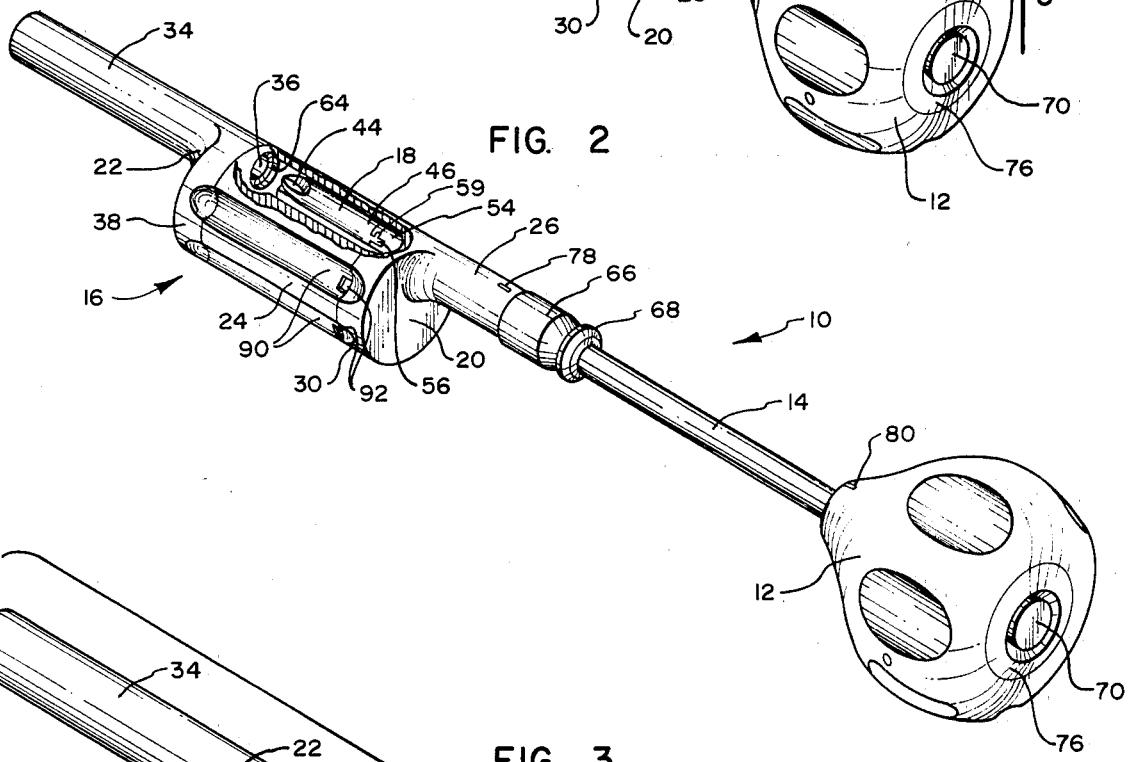
FIG. 2 is a perspective view showing the shaft in its fully retracted position with a portion of the cylinder assembly broken away to illustrate the tip when it is retracted into a cylinder chamber.

Referring now specifically to the drawings, wherein like numerals indicate like parts throughout, the multi-tip tool is generally designated 10 in FIGS. 1 and 2, and comprises a handle 12, a shaft 14, a cylinder assembly generally designated at 16, and a plurality of tips 18. The shaft 14 is firmly affixed to the handle 12 such that angular rotation of the handle 12 imparts such rotation to the shaft 14. The shaft 14 is preferably cylindrical so that it may freely rotate about its longitudinal axis independent of the cylinder assembly 16. However, it should be understood that the shaft 14 could have a polygonal cross-section. A shaft 14 having a polygonal cross-section will not rotate free and independent of the cylinder assembly 16 if it is mounted in a corresponding polygonal bore and will rotate free and independent of the cylinder assembly if mounted within a circular bore.

Figure 3:
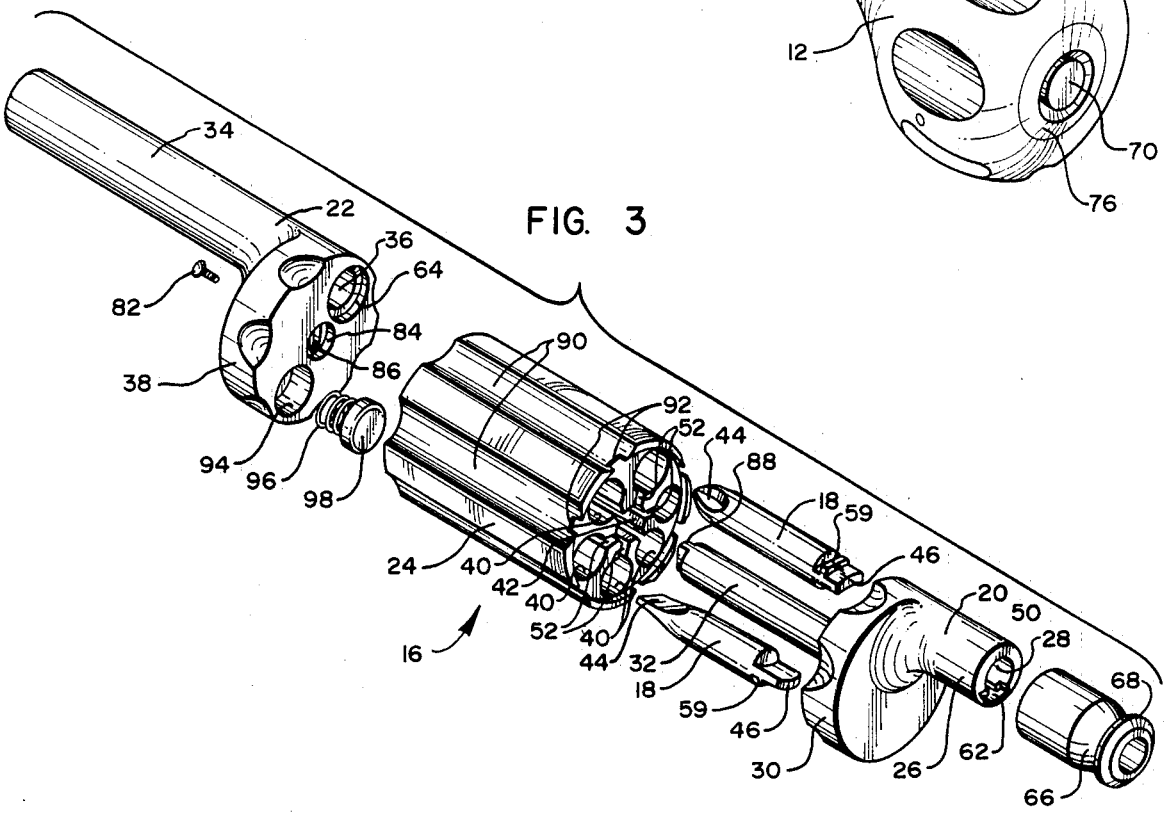
FIG. 3 is an exploded perspective view of the cylinder assembly and a pair of working tips.

The cylinder assembly 16 comprises a rear barrel portion 20, a forward barrel portion 22, and a cylinder 24. As shown best in FIG. 3, the rear barrel portion 20 has a neck 26 with a bore 28, a flange 30, and a spindle 32. The bore 28 of neck 26 is shaped to align with and to receive in sliding longitudinal engagement the shaft 14. The spindle 32, which is attached to or constructed unitary with the flange 30, is disposed such that its longitudinal axis is substantially parallel to and offset from the longitudinal axis of the bore 28 (which is also the longitudinal axis of shaft 14 when the tool 10 is assembled). The forward barrel portion 22 has a neck 34 with a bore 36, and a flange 38. The flange 38 of the forward barrel portion 22 is held in spaced relationship from the flange 30 of the rear barrel portion 20 by the spindle 32. The bore 36 of neck 34 aligns with the bore 28 of neck 26. Disposed between the flange 30 of rear barrel portion 20 and the flange 38 of forward barrel portion 22 and about the spindle 32 is the cylinder 24.

The cylinder 24 comprises a plurality of chambers 40 arranged circumferentially about a central conduit 42. The central conduit 42 receives the spindle 32 of rear barrel portion 20 thereby permitting the cylinder 24 to rotate about the spindle 32. As the cylinder 24 is rotated about spindle 32, each of the chambers 40, in turn, aligns with bore 28 of the rear barrel portion 20 and bore 36 of the forward barrel portion 22.

Although the spindle 32 has been described as part of rear barrel portion 20, it should be understood that other types of spindles or axes may be used. For example, the spindle could be a separate component positioned between the two barrel portions or it could be part of the forward barrel portion 22.

Each tip 18 has a forward end 44 and a connecting end 46 and is stored within a chamber 40 of the cylinder 24. The forward end 44 of each tip 18 may be configured in any of a variety of ways such as a straight edge screw driver, a Phillips screw driver, an awl, a chisel, a socket, or the like. The forward end 44 may also be a variety of sizes of the same type of working tip. For example, the cylinder 24 may house a plurality of tips 18 having various sizes of straight edge screw driver ends.

The cylinder assembly 16 is disposed to receive shaft 14 in slidable, longitudinal engagement. FIG. 1 shows the shaft in its fully extended position, extending through the bore 28 of rear barrel portion 20, through a chamber 40 of cylinder 24, and into the bore 36 of forward barrel portion 22. In a preferred embodiment, the handle 12, shaft 14, and the tip 18 coupled to the shaft 14 are free to rotate independent of the cylinder assembly 16 in this fully extended position, as will be explained more fully below. As the handle 12 is retracted, the shaft 14 is withdrawn from its fully extended position. When fully retracted, shaft 14 is positioned so that it may release the tip 18 to which it is coupled prior to engaging a new tip 18 in coupling engagement. It is preferred that the shaft 14 not be permitted to rotate during retraction or once it is fully retracted, as shown in FIG. 2. This assures that the shaft 14 will be properly positioned for release and coupling engagement with the various tips 18 stored within the cylinder 24.

Figure 5:
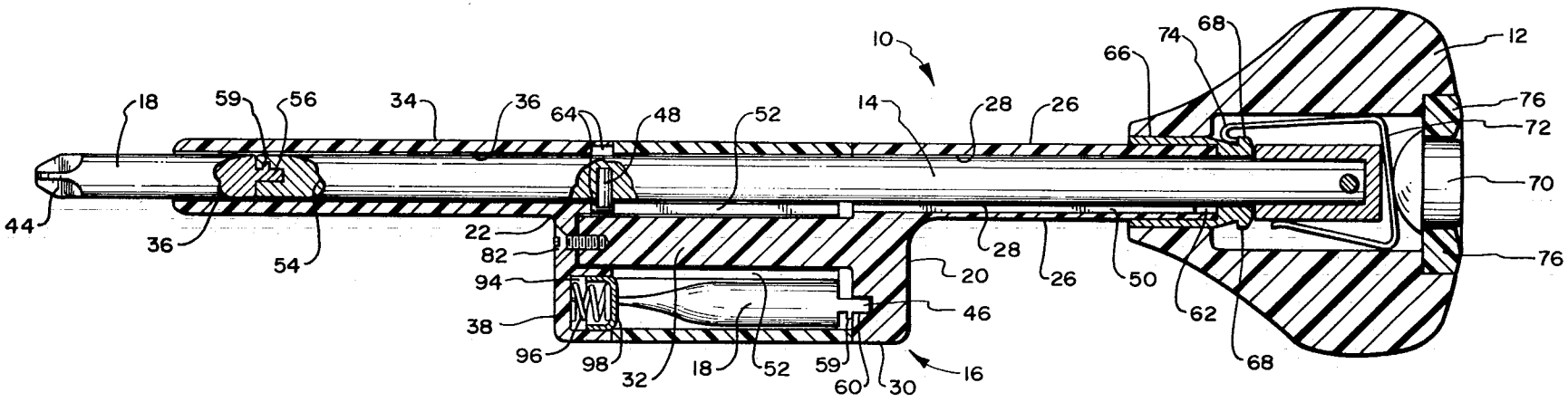
FIG. 5 is a partial longitudinal section view taken along line 5—5 of FIG. 1 wherein the shaft is in a fully extended position and portions of the shaft are broken away to show the pin guide and the coupling of the shaft to a working tip.
Figure 6:
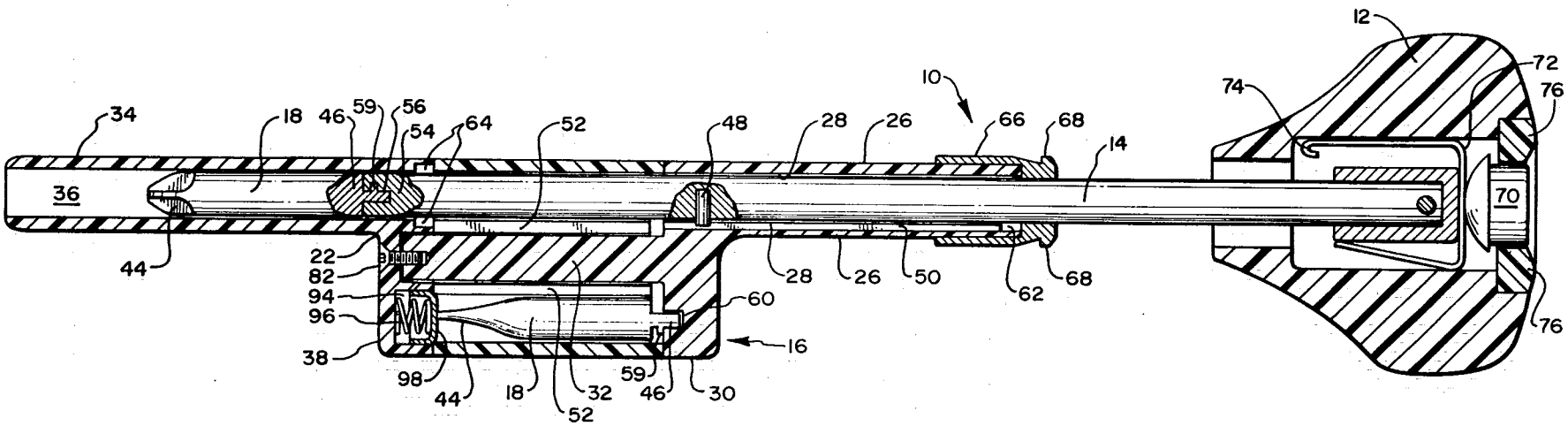
FIG. 6 is a partial longitudinal section view of the invention shown in FIG. 5 wherein the shaft is partially retracted so as to show the pin guide within the keyway used to lock the shaft.

To assure that the shaft 14 is prevented from rotation during retraction, it is preferred that shaft 14 have a pin guide 48 (shown in FIGS. 5 and 6) which protrudes from the side of the shaft 14. As shown best in FIG. 3, 5 and 6, keyway 50 in the neck 26 of rear barrel portion 20 and a plurality of slots 52 disposed about the periphery of central conduit 42 and each communicating with a chamber 40 are provided to slidably receive the pin guide 48 and to prevent any angular rotation of the pin guide 48 during retraction or extension of the shaft 14 between the fully extended and fully retracted positions. FIG. 6 shows the shaft 14 in a partially retracted position in which the pin guide 48 is disposed in keyway 50.

Figure 4:
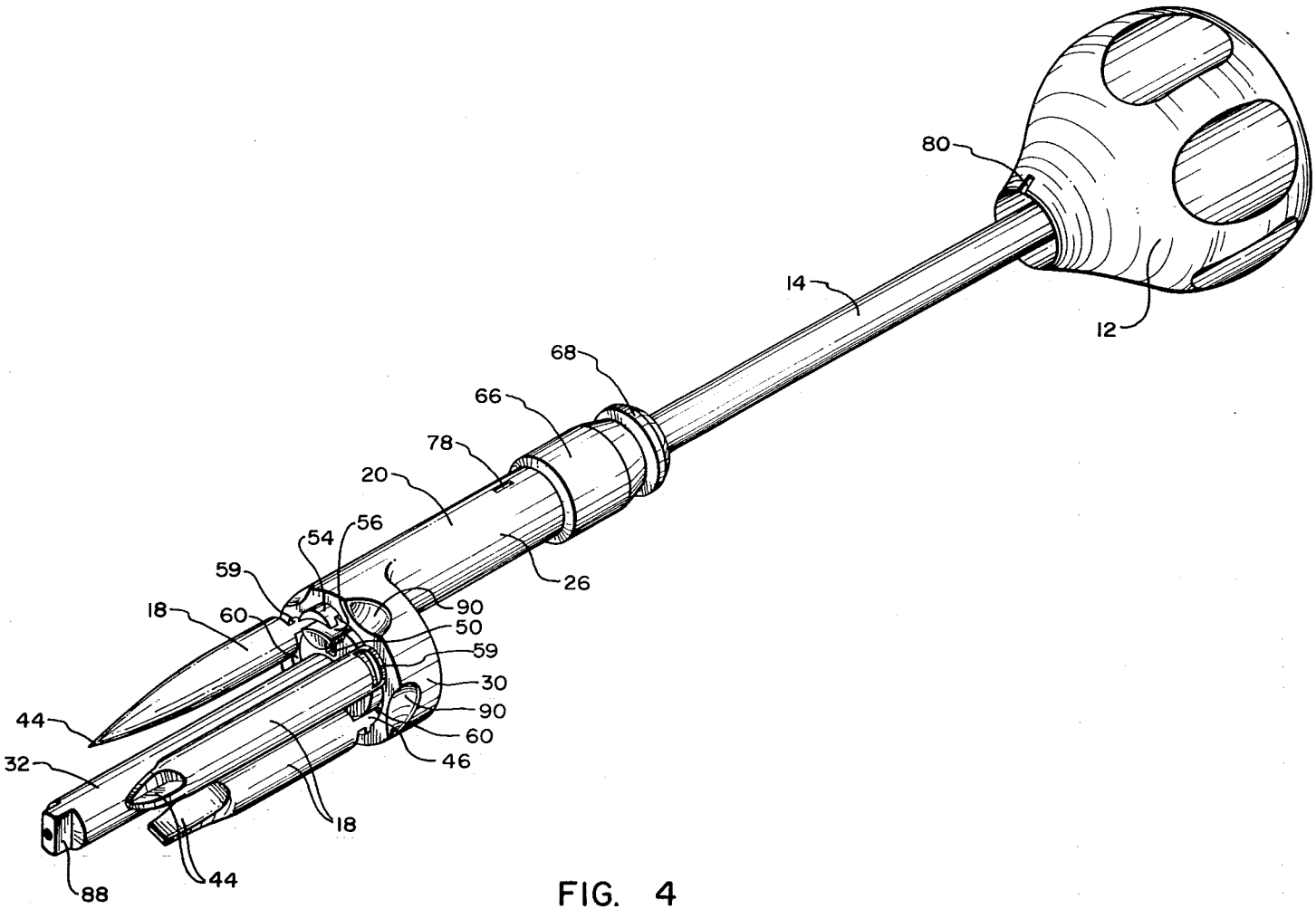
FIG. 4 is an enlarged perspective view of a portion of the instrument showing the shaft fully retracted into the rear barrel portion of the cylinder assembly and illustrating a plurality of tips set in an annular channel which assists in feeding each tip to the shaft for coupling engagement.

When the shaft 14 is fully retracted, as shown in FIGS. 2 and 4, the distal end 54 of the shaft 14 is positioned for engagement or disengagement with each tip 18 stored within chambers 40 of the cylinder 24. In the preferred embodiment of the invention, the distal end 54 of the shaft 14 has an arcuate groove 56 for receiving, in turn, the connecting end 46 for each of tips 18. The connecting end 46 for each tip 18 has an arcuate tongue 59 which effects a tongue and groove engagement with the arcuate groove 56 of the shaft 14 when the tip 18 is rotated into alignment with the shaft 14.

Although it is preferred that tip 18 have arcuate tongue 59 and the shaft 14 have arcuate groove 56, it should be understood that other means for coupling each tip 18 to the shaft 14 may be implemented without departing from the spirit and scope of the present invention. For example, the shaft may have an arcuate tongue and each tip may have an arcuate groove. It is also preferred that the tongue and groove arrangement described above be arcuate in order to reduce the likelihood of binding the tip 18 against the shaft 14 during rotation of the cylinder 24 to select the appropriate tip 18.

In addition, it is preferred that the flange 30 of rear barrel portion 20 have an annular channel 60, as shown in FIG. 4, for receiving the end 46 of each tip 18. This annular channel 60 prevents each tip 18 from twisting and provides proper alignment between the tongue 59 of each tip 18 and the groove 56 of the shaft 14 as the cylinder 24 is rotated. The tongue and groove arrangement may have any configuration; however, it is preferred that the arcuate tongue 59 rests on the flange 30 and assists in properly positioning the arcuate tongue 59 for engagement with the arcuate groove 56 of shaft 14.

To facilitate the proper engagement of the tongue and groove assembly a transverse duct 62 (shown best in FIG. 3) is provided at the end of the keyway 50 to permit limited angular rotation or wiggling of the shaft 14. Such wiggling is provided to compensate for any slight misalignment of the tongue and groove assembly. In this way, as each tip 18 is rotated into alignment with the shaft 14, the arcuate tongue 59 engages the arcuate groove 56 and the shaft 14 may be rotated slightly (as permitted by transverse duct 62) to accomplish the positive coupling of the tip 18 to the shaft 14.

Once the desired tip 18 is coupled to the shaft 14, the shaft 14 may be extended through the chamber 40 and into the bore 36 of the forward barrel portion 22. As with retraction of the shaft 14, extension of the shaft 14 is also guided by the pin guide 48 sliding in keyway 50 and the slot 52 associated with the aligned chamber 40. When fully extended, the pin guide 48 enters into a recess 64 (shown best in FIG. 3) formed about the opening of bore 36. Recess 64 permits the pin guide 48 to freely rotate when the shaft 14 is turned about its longitudinal axis. Thus, the handle 12 and shaft 14, as well as the selected tip 18 which is coupled to the shaft 14, may rotate freely and independently of the cylinder assembly 16. This permits the torque applied to the handle 12 to be directly transmitted to the working tip 18 without interference from the cylinder assembly 16. Further, the cylinder assembly 16 may serve as a stabilizing handle or grip which can be held to position the tool for the work to be performed.

In the preferred embodiment, a mechanism is provided to secure the cylinder assembly 16 to the handle 12 to prevent longitudinal sliding of the cylinder assembly 16 on shaft 14 while permitting rotation of the shaft 14. This mechanism comprises a sleeve 66 with an annular lip 68 attached to the neck 26 of rear barrel portion 20, and a corresponding catch mechanism located internally within handle 12. This catch mechanism preferably comprises a button 70 and a spring latch 72 (see FIGS. 5 and 6) with a hook 74. As the cylinder assembly 16 moves such that the shaft 14 approaches its fully extended position, the lip 68 of sleeve 66 engages the hook 74. The hook 74 captures the edge of the lip 68, as shown in FIG. 5, when the shaft is fully extended. Since the lip 68 is annular, the workman utilizing the tool may rotate the cylinder assembly 16 about the longitudinal axis of the shaft 14 without disengaging the sleeve 66 from the spring latch 72.

The button 70 is held adjacent the spring latch 72 by a cap 76 shown in FIGS. 5 and 6. To release the sleeve 66 from the spring latch 72, the workman depresses button 70 which actuates the spring latch 72 to remove hook 74 from the annular lip 68 of sleeve 66. When so released, the cylinder assembly 16 may slidably move along shaft 14 provided that guide pin 48 enters slot 52 and keyway 50.

To indicate the proper disposition of cylinder assembly 16 with respect to handle 12 in aligning pin guide 48 with slot 52 and keyway 50, a pair of aligning indicators are provided. One alignment indicator 78 is provided on the exterior of neck 26 of rear barrel portion 20 and a second alignment indicator 80 is provided on handle 12. When alignment indicators 78 and 80 are aligned, the shaft 14 may be longitudinally retracted or extended within cylinder assembly 16 because the pin guide 48 will slidably engage a slot 52 and keyway 50.

Figure 7:
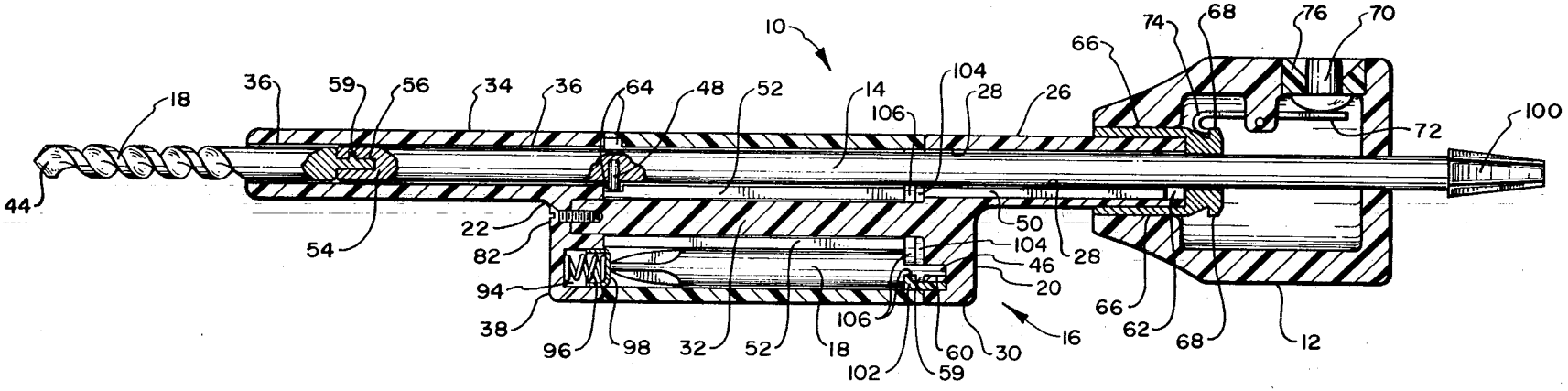
FIG. 7 is a partial longitudinal section view of an alternative embodiment of the invention adapted for attachment to a power tool and showing the shaft in its fully extended position.

Although the invention described above is particularly adapted for hand manipulation, it should be understood that the multi-purpose tool 10 may be connected to a power driven tool such as a power drill or a power screw driver. With the power driven embodiment, as shown in FIG. 7, the shaft 14 would extend beyond the handle 12 and have an attachment end 100 to be coupled to the power tool (not shown) and a distal end 54 to slide longitudinally within a cylinder assembly 16. The connection of the attachment end 100 of shaft 14 to a power tool could be accomplished in any number of conventional ways such as tightening a chuck onto the shaft 14 or tightening a locking screw. Thus, when the shaft 14 is fully extended into and free to rotate independently of the cylinder assembly 16 and locked into that position (via a locking mechanism such as the sleeve and catch described above), the power tool could be activated to rotate the working tip 18. In this manner, the working tip 18, shaft 14 and handle 12 would rotate per the rotation imparted by the power tool. The cylinder assembly 16, however, would not rotate but would serve as a stabilizing grip to position and support the tool. With this embodiment, there is no eccentric rotation of the cylinder assembly 16 which could make the tool difficult to handle or even dangerous to use.

The power tool embodiment, shown in FIG. 7, may be used as a hand tool or a power tool. Further, the power tool embodiment makes it particularly advantageous to house within the cylinder assembly 16 a plurality of various sized drill bit working tips 18 to be coupled to the shaft 14 and advanced to the appropriate working position. Thus, various sized drill bits can be used interchangeably without having to repeatedly go through the procedure of removing the unwanted bit, replacing it with another bit, and securing the selected bit to the power tool.

Figure 8:
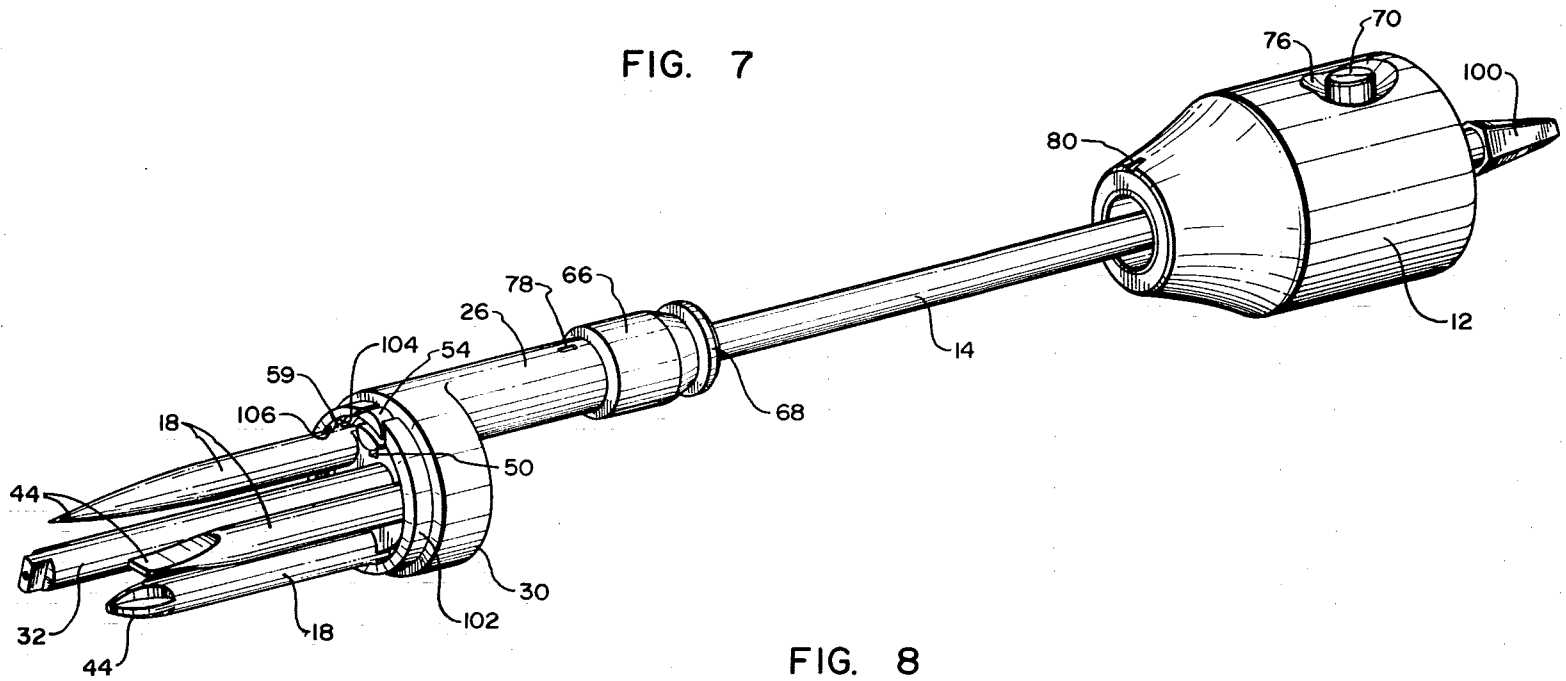
FIG. 8 is an enlarge perspective view of a portion of the instrument shown in FIG. 7 showing the shaft fully retracted into the rear barrel portion of the cylinder assembly and illustrating a guide ring for holding the working tips within the annular channel.

FIGS. 7 and 8 also illustrate a feature of another embodiment of the present invention. This feature makes it possible to interchange tools in rapid succession no matter the orientation in which the multi-tip tool is held. The feature comprises a guide ring 102 adjacent to and concentric with the annular channel 60, the guide ring 102 is split to accommodate shaft 14. This guide ring 102 holds the connecting end 46 of each tip 18 from displacement within annular channel 60 when the tool 10 is held in any orientation. The guide ring 102 has a projecting rim 106 which defines a groove 104. The groove 104 and annular channel 60 are adapted for receiving the arcuate tongue 59 of each tip 18, as best shown in FIG. 8. The guide ring 102 cooperates with each tip 18 to assist the aligned delivery of each tip 18 to the distal end 54 of shaft 14 for smooth coupling engagement.

The guide ring 102 may be constructed unitary with the flange 30 of rear barrel portion 22 or it may be constructed of a separate piece of material disposed in the position described above. Further, although the embodiment showing the guide ring 102 is the power tool embodiment, it should be understood that the guide ring 102 could also be used with the hand tool embodiment.

Several other features are provided in the most preferred embodiment of the invention. First, the cylinder assembly 16 is held together by a single screw or bolt 82 which extends through the flange 38 of forward barrel portion 22 and engages, in threaded engagement, the spindle 32. By removing this single screw 82 the entire cylinder assembly 16 may be dismantled and the tips 18 may be exchanged for other tips within the cylinder 24. This feature greatly increases the versatility of the tool 10, because it provides a way in which other tips can be used with the tool. Thus, if a workman knows in advance that he will require a certain contingent of working tips 18, he may hand load the cylinder 24 with the desired tips 18, thereby customizing the implement for his desired use.

Further, flange 38 of forward barrel portion 22 has a cup 84 with an indentation 86 for receiving a protrusion 88 on spindle 32. Engagement of protrusion 88 with indentation 86 assures that bores 28 and 36 are aligned when the cylinder assembly 16 is assembled and further prevents rotation of the barrel portions 20 and 22 out of mutual alignment.

A plurality of gripping grooves 90 (see FIGS. 1 and 2), disposed about the periphery of cylinder 24 and which may extend slightly into the adjacent flanges 30 and 38, facilitate the visual alignment and the manual rotation of the cylinder 24 within the cylinder assembly 16. Moreover, if the cylinder 24 is made of a see-through or transparent material, the workman using the tool 10 may visually select the appropriate tip 18 without having to make a series of trial-and-error selections until he arrives at the tip 18 he desires.

Another feature enhancing the versatility, flexibility and operations of the multi-purpose tool 10 of the present invention is the plurality of cut-outs 92 (see FIGS. 1–3) disposed along the lower edge of cylinder 24 between each of the chambers 40. These cut-outs 92 provide access to the connecting end 46 and the tongue 59 for each of the tips 18 so that the workman may adjust the alignment of the connecting ends 46 into the annular channel 60 (see FIG. 4), if necessary. This is particularly helpful while reassembling the cylinder assembly 16 after exchanging tips 18. The cut-outs 92 may not be necessary when a guide ring 102 is used, as shown in FIGS. 7 and 8.

To facilitate the proper alignment of a chamber 40 with respect to the shaft 14, a spring loaded detent is provided. A cavity 94 in flange 38 of forward barrel portion 22 is provided which houses a spring 96 and a detent cap 98. The spring 96 provides resiliency to the detent cap 98 such that the detent cap 98 slightly enters each chamber 40 of cylinder 24, in turn, as the cylinder 24 is rotated. The detent cap 98 makes a "clicking" sound as it engages each chamber 40, thus indicating that the chamber 40 directly opposite the chamber 40 in which the detent cap 98 has entered is in alignment with the shaft 14. As the cylinder 24 is rotated out of alignment, the detent cap 98 withdraws from that chamber 40 and enters the next chamber 40 when alignment is next achieved.

To operate the multi-tip tool 10 of this invention a workman would grasp the tool and align indicators 78 and 80. He would then depress button 70 to release spring latch 72 thereby freeing sleeve 66 and the cylinder assembly 16 for longitudinal sliding movement along shaft 14. Holding button 70 depressed until sleeve 66 is releasably displaced, the workman would then retract shaft 14 to its fully retracted position (as shown in FIG. 2). Next, the workman would select the desired tip 18 by rotating the cylinder 24 about the spindle 32 until the desired tip 18 is brought into alignment with the shaft 14 and the arcuate tongue 59 engages the arcuate groove 56 of shaft 14 in coupling engagement. If necessary, the shaft 14 may be wiggled slightly in this position (via pin guide 48 and transverse duct 62) to assure that the tongue and groove coupling is positively effected. The shaft 14 may then be extended through the aligned chamber 40 and into bore 36 such that the end 44 of tip 18 protrudes beyond neck 34 of forward barrel portion 22. When shaft 14 is fully extended, pin guide 48 enters recess 64 thereby permitting the free rotation of handle 12, shaft 14, and the selected tip 18. Thus, the working end 44 may engage a workpiece (not shown) to provide the work desired.

When the workman desired to use a different tip 18, he merely aligns indicators 78 and 80 and depresses the button 70 to release the cylinder assembly 16 to longitudinally slide along shaft 14. The workman then retracts the shaft 14 fully and selects the next desired tip 18 by rotating cylinder 24 until the desired tip 18 aligns with and engages the shaft 14. The shaft 14 can then be extended exposing the working end 44 of the selected tip 18 so that it can be used to perform the desired work on the workpiece.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A multi-purpose tool comprising:

a plurality of working tips;

a cylinder assembly comprising first and second barrel portions and a cylinder mounted between said barrel portions, said cylinder having a plurality of chambers for housing said plurality of working tips;

a shaft for engaging said working tips, said shaft being mounted to said cylinder assembly in longitudinal sliding engagement, said shaft being movable through said cylinder assembly between a first position and a second position;

means for coupling one of the working tips to said shaft when said shaft is in its first position and the working tip is housed within one of the chambers, the working tip coupled to said shaft being advanced to a working position as said shaft is slidably moved from its first position to its second position; and means for permitting rotation of said cylinder independent of said barrel portions and said shaft when said shaft is in its first position, and for permitting rotation of said shaft independent of said barrel portions and said cylinder when said shaft is in its second position.

2. A multi-purpose tool as set forth in claim 1 further comprising means for selecting which of the plurality of working tips is to be coupled to said shaft and for feeding the desired working tip into coupling engagement with said shaft without removing the desired working tip from the cylinder assembly.

3. A multi-purpose tool as set forth in claim 2 wherein said means for selecting and feeding the desired tip for coupling engagement with such pin comprises means for rotating said cylinder when said shaft is in its first position.

4. A multi-purpose tool as set forth in claim 3 wherein the axis for rotation of said cylinder is substantially parallel to and offset from the longitudinal axis of said shaft.

5. A multi-purpose tool as set forth in claim 1 wherein said means for coupling one of the working tips to said shaft comprises an arcuate tongue and groove assembly.

6. A multi-purpose tool as set forth in claim 5 wherein each working tip has an arcuate tongue for coupling engagement with said shaft.

7. A multi-purpose tool as set forth in claim 6 wherein said cylinder assembly has an annular channel for receiving the arcuate tongue of each working tip and for maintaining each working tip in alignment for coupling engagement with said shaft.

8. A multi-purpose tool as set forth in claim 7 wherein said cylinder assembly further comprises a guide ring for holding the arcuate tongue of each working tip in arcuate alignment for coupling engagement with said shaft.

9. A multi-purpose tool as set forth in claim 1 wherein said means for permitting independent rotation of said shaft comprises a pin guide which protrudes from said shaft in a longitudinal keyway in said cylinder assembly for receiving said pin guide in sliding engagement, thereby preventing rotation of said shaft independent of said cylinder assembly when the pin guide is within the keyway.

10. A multi-purpose tool as set forth in claim 9 wherein said means for permitting independent rotation of said shaft while said shaft is in its second position comprises a recess within said cylinder assembly disposed for receiving said pin guide and being positioned to accommodate rotation of said pin guide when said shaft is rotated about its longitudinal axis.

11. A multi-purpose tool as set forth in claim 9 wherein said keyway has a transverse duct disposed for receiving said pin guide when said shaft is in its first position, said transverse duct thereby permitting limited rotation of the shaft with respect to said cylinder assembly to assure positive engagement of the working tip to the shaft.

12. A multi-purpose tool comprising:

a handle;

a shaft having one end affixed to the handle and a distal end extending outwardly from the handle;

a cylinder assembly slidably engaging the shaft comprising:

a first barrel having a first bore for receiving the shaft in longitudinal sliding engagement;

a second barrel spaced from the first barrel having a second bore aligned with the first bore; and a cylinder rotatably disposed between the first and second barrels and having a plurality of chambers formed in said cylinder, and said cylinder having an axis of rotation offset from and substantially parallel to the longitudinal axis of the shaft such that each chamber, in turn, aligns with the first and second bores as the cylinder is rotated;

a plurality of working tips each stored within one of said chambers and each having a connecting end and a working end;

means for coupling, in turn, the connecting end of each of said tips with the distal end of the shaft so as to enable each tip to be connected to said shaft so that when connected a tip can be extended and retracted through said first bore, as desired; and means for locking said shaft to prevent rotation thereof independent of said cylinder assembly except when said shaft is in its fully extended position.

13. A multi-purpose tool as set forth in claim 12 wherein said means for coupling, in turn, the connecting end of each tip with the distal end of said shaft comprises an arcuate tongue and groove assembly.

14. A multi-purpose tool as set forth in claim 13 wherein said first barrel further comprises a first flange for supporting the cylinder and having an annular channel for receiving and maintaining alignment of the connecting end of each said tip.

15. A multi-purpose tool as set forth in claim 13 wherein said shaft is cylindrical and wherein said shaft further comprises a pin guide which protrudes from the shaft, and said first barrel further comprising a longitudinal keyway for receiving said pin guide in sliding engagement, thereby preventing rotation of said shaft within the first bore when the pin guide is within the keyway.

16. A multi-purpose tool as set forth in claim 15 wherein said cylinder assembly further comprises a recess disposed for receiving said pin guide when said shaft is fully extended through the first barrel and a chamber of said cylinder, said recess being formed at the opening of said second bore and being positioned to accommodate rotation of said pin guide when said shaft is rotated about its longitudinal axis.

17. A multi-purpose tool as set forth in claim 15 wherein said keyway has a transverse duct disposed for receiving said pin guide when the shaft is fully retracted, said transverse duct thereby permitting limited rotation of the shaft to assure positive engagement of said connecting end of said tip to the distal end of said shaft.

18. A multi-purpose tool as set forth in claim 12 further comprising means for releasably locking said cylinder assembly when said shaft is in its fully extended position, thereby preventing said shaft from being retracted until said locking means is released.

19. A multi-purpose tool as set forth in claim 18 wherein said means for releasably locking the shaft in its fully extended position comprises a sleeve and catch assembly.

20. A multi-purpose tool as set forth in claim 19 wherein said sleeve and catch assembly comprises a sleeve affixed to said first barrel and a catch affixed to said handle, said catch releasably capturing the sleeve when the shaft is fully extended in relation to the cylinder assembly.

21. A multi-purpose tool as set forth in claim 20 wherein said catch comprises a spring and a button, said button actuating the spring to release the sleeve when the button is depressed.

22. A multi-purpose tool as set forth in claim 12 wherein said cylinder is constructed of a transparent material to enable visual selection of the desired tool.

23. A multi-purpose tool as set forth in claim 12 further comprising a chamber indicator which releasably engages in turn each said chamber of said cylinder so as to position the engaged chamber in alignment with said first and second bores.

24. A multi-purpose tool as set forth in claim 23 wherein the chamber indicator is a spring-loaded detent.

25. A method for operating a multi-purpose tool to perform work on a work piece, the multi-purpose tool having a handle with an attached shaft, a cylinder assembly slidably engaging the shaft, a plurality of working tips each stored within a separate chamber of a cylinder of the cylinder assembly, and means for coupling, in turn, each tip to the shaft, said method comprising the steps of:

(a) selecting the desired tip by rotating the cylinder until the chamber housing the desired tip is aligned with the shaft and the tip engages the shaft;

(b) extending the shaft slidably into the cylinder assembly until a portion of the tool protrudes from the cylinder assembly;

(c) locking shaft to prevent rotation thereof independent of the cylinder assembly except when the shaft is in its fully extended position;

(d) rotating the cylinder assembly independently of said shaft and engaging the protruding portion of the tool with the work piece while the shaft is in its fully extended position; and (e) manipulating the tool to perform the desired work on the work piece.

26. A method as set forth in claim 25 wherein said step of manipulating said tool comprises rotating the handle to impart a torque to the shaft of said tool.

27. A method as set forth in claim 25 wherein the shaft has a pin guide and the cylinder assembly has a keyway for receiving the pin guide in slideable engagement, said pin guide and keyway preventing rotation of the shaft independent of the cylinder assembly when the pin guide is within the keyway.

28. A method as set forth in claim 27 wherein the cylinder assembly has a recess for receiving the pin guide and permitting the rotation of the shaft independent of the cylinder assembly when said shaft is fully extended.

29. A method as set forth in claim 28 wherein said step of manipulating said tool comprises rotating the handle independent of the cylinder assembly to impart a torque to the shaft of said tool.

30. A method as set forth in claim 27 wherein the cylinder assembly has a transverse duct which permits limited rotation of the cylinder assembly about the shaft during said step (b) of selecting the desired tip, and said step (b) further comprising wiggling the shaft to assure proper engagement of the shaft with the selected tip.

31. A method for changing the tip of a multi-purpose tool having a handle with an attached shaft, a cylinder assembly slidably engaging the shaft, a plurality of working tips each stored within a chamber of a cylinder of the cylinder assembly, and means for coupling, in turn, each tip to the shaft, wherein one tip is so coupled and a portion thereof protrudes from the cylinder assembly and the shaft, being fully extended, occupies the chamber for such tip, said method comprising the steps of:

(a) retracting the shaft from its fully extended position thereby drawing the tip coupled to the shaft from its position protruding from the cylinder assembly into a chamber of said cylinder;

(b) disengaging the tip coupled to the shaft and selecting the next desired tip by rotating the cylinder until the chamber housing the desired tip is aligned with the shaft and that tip engages the shaft in coupling engagement;

(c) extending the shaft slidably into the cylinder assembly until a portion of the desired tip protrudes from the cylinder assembly;

(d) locking said shaft to prevent rotation thereof independent of the cylinder assembly except when the shaft is in its fully extended position;

(e) rotating the cylinder assembly independently of said shaft and engaging the desired tip with a work piece when the shaft is in its fully extended position.

32. A method as set forth in claim 31 wherein the step of retracting the shaft includes sliding a pin guide within a keyway in the cylinder assembly for receiving the pin guide in slidable engagement, said pin guide and keyway preventing rotation of the shaft independent of the cylinder assembly when the pin guide is within the keyway.

33. A method as set forth in claim 32 wherein the cylinder assembly has a transverse duct which permits limited rotation of the cylinder assembly about the shaft during said step (b) of disengaging the tip, and said step (b) further comprising the step of wiggling the shaft to assure proper engagement of the shaft with the selected tool.

34. A method as set forth in claim 31 wherein said multi-purpose tool further comprises means for releasably securing the cylinder assembly when the shaft is in its fully extended position, and wherein said method further comprises the step of disengaging the means for releasably securing the shaft prior to said step (a) of retracting the shaft.

35. A method as set forth in claim 34 wherein the means for releasably securing the shaft comprises a sleeve affixed to the cylinder assembly and a catch affixed to the handle and the step of disengaging the means for releasably securing the shaft includes disengaging the catch from the sleeve.

36. A method as set forth in claim 35 wherein the catch comprises a spring and a button and the step of disengaging the means for releasably securing the shaft comprises the step of depressing the button to actuate the spring which releases the sleeve.

37. A method as set forth in claim 32 wherein the cylinder assembly has a first mark and the handle has a second mark which, when aligned, indicate the position of the cylinder assembly in relation to the handle required for the pin guide to slidably engage the keyway during extension or retraction of the shaft within the cylinder assembly and wherein said method further comprises the step of aligning the first mark and the second mark prior to said step (a) of retracting the shaft.

38. A multi-purpose tool for use in conjunction with a power tool, comprising:

a plurality of working tips;

a cylinder assembly having a plurality of chambers for housing said plurality of working tips;

a shaft having an attachment end for attachment to the power tool and a distal end engaging said cylinder assembly in longitudinal sliding engagement, said cylinder assembly movable on said shaft between a first position and a second position;

means for coupling one of said working tips to the distal end of said shaft when said cylinder assembly is at its first position and the working tip is housed within one of the chambers; said working tip coupled to the distal end of said shaft being advanced to a working position as the cylinder assembly is slidably moved from its first position to its second position;

means for permitting rotation of said shaft as driven by the power tool independent of said cylinder assembly, and for permitting rotation of said cylinder assembly about said shaft, when said cylinder assembly is at its second position; and means for locking said shaft to prevent rotation thereof independent of said cylinder assembly except when said cylinder assembly is at its second position.

39. A multi-purpose tool as set forth in claim 38 further comprising means for selecting which of the plurality of tips is to be coupled to the distal end of said shaft and for feeding the desired tip into coupling engagement with said shaft.

40. A multi-purpose tool as set forth in claim 39 wherein said cylinder assembly comprises a cylinder which houses the working tips and said means for selecting and feeding the desired tip for coupling engagement with said shaft comprises means for rotating said cylinder when said cylinder assembly is at its first position.

41. A multi-purpose tool as set forth in claim 40 wherein the axis for rotation of said cylinder is substantially parallel to and offset from the longitudinal axis of said shaft.

42. A multi-purpose tool as set forth in claim 38 wherein said means for coupling one of the working tips to the distal end of said shaft comprises an arcuate tongue and groove assembly.

43. A multi-purpose tool as set forth in claim 42 wherein each working tip has an arcuate tongue for coupling engagement with and arcuate groove in the distal end of said shaft.

44. A multi-purpose tool as set forth in claim 43 wherein said cylinder assembly has an annular channel for receiving the arcuate tongue of each working tip and for maintaining each working tip in alignment for coupling engagement with said shaft.

45. A multi-purpose tool as set forth in claim 44 wherein said cylinder assembly further comprises a guide ring for holding the arcuate tongue of each working tip in arcuate alignment for coupling engagement with said shaft.

46. A multi-purpose tool as set forth in claim 38 wherein said means for locking said shaft comprises a pin guide which protrudes from said shaft in a longitudinal keyway in said cylinder assembly for receiving said pin guide in sliding engagement, thereby preventing rotation of said shaft independent of said cylinder assembly when the pin guide is within the keyway.

47. A multi-purpose tool as set forth in claim 46 wherein said means for permitting independent rotation of said shaft when said cylinder assembly is at its second position comprises a recess within said cylinder assembly disposed for receiving said pin guide and being positioned to accommodate rotation of said pin guide when said shaft is rotated about its longitudinal axis.

48. A multi-purpose tool as set forth in claim 46 wherein said keyway has a transverse duct disposed for receiving said pin guide when said cylinder assembly is at its first position, said transverse duct thereby permitting limited rotation of the shaft with respect to said cylinder assembly to assure positive engagement of the working tip to the shaft.

49. A multi-purpose tool as set forth in claim 38 further comprising means for releasably locking said cylinder assembly at its second position, thereby preventing longitudinal sliding movement of said cylinder assembly until said locking means is released.

50. A multi-purpose tool as set forth in claim 49 wherein said means for releasably locking said cylinder assembly at its second position comprises a sleeve and catch assembly.

51. A multi-purpose tool as set forth in claim 50 wherein said sleeve and catch assembly comprises a sleeve affixed to said cylinder assembly and a catch connected to said shaft, said catch releasably capturing the sleeve when the cylinder assembly is at its second position.

52. A multi-purpose tool as set forth in claim 51 wherein said catch comprises a spring and a button, said button actuating the spring to release the sleeve when the button is depressed.

53. A multi-purpose tool comprising:

a plurality of working tips;

a cylinder assembly having a cylinder with a plurality of chambers, each chamber for housing one of said plurality of working tips; p1 a shaft having an end which selectively engages each said chamber of said cylinder assembly in longitudinal sliding engagement, said shaft end movable through a selected cylinder chamber between a first position and a second position;

means for coupling a selected working tip to said shaft end when said shaft end is in its first position and is moved from one chamber to said selected cylinder chamber; the working tip coupled to said shaft end being advanced from said selected cylinder chamber to a working position as said shaft end is slidably moved from its first position through said selected chamber to its second position; and means for locking said shaft to prevent rotation thereof independent of said cylinder assembly except when said shaft is in its second position.

54. A multi-purpose tool as set forth in claim 53 further comprising means for selecting which of the plurality of working tips is to be coupled to said shaft end and for feeding the desired working tip into coupling engagement with said shaft.

55. A multi-purpose tool as set forth in claim 54 wherein and said means for selecting and feeding the desired working tip for coupling engagement with said shaft end comprises means for rotating said cylinder when said shaft end is in its first position.

56. A multi-purpose tool as set forth in claim 55 wherein the axis for rotation of said cylinder is substantially parallel to and offset from the longitudinal axis of said shaft.

57. A multi-purpose tool as set forth in claim 53 wherein said means for coupling one of the working tips to said shaft end comprises an arcuate tongue and groove assembly.

58. A multi-purpose tool as set forth in claim 57 wherein each working tip has an arcuate tongue for coupling engagement with an arcuate groove of said shaft end.

59. A multi-purpose tool as set forth in claim 58 wherein said cylinder assembly has an annular channel for receiving the arcuate tongue of each working tip and for maintaining each working tip in alignment for coupling engagement with said shaft end.

60. A multi-purpose tool as set forth in claim 59 wherein said cylinder assembly further comprises a guide ring for holding the arcuate tongue of each working tip in arcuate alignment for coupling engagement with said shaft end.

61. A multi-purpose tool as set forth in claim 53 wherein said means for locking said shaft comprises a pin guide which protrudes from said shaft in a longitudinal keyway in said cylinder assembly for receiving said pin guide in sliding engagement, thereby preventing rotation of said shaft independent of said cylinder assembly when the pin guide is within the keyway.

62. A multi-purpose tool as set forth in claim 61 further comprising means for permitting rotation of said shaft independent of said cylinder assembly when said shaft end is in its second position.

63. A multi-purpose tool as set forth in claim 62 wherein said means for permitting independent rotation of said shaft when said shaft end is in its second position comprises a recess within said cylinder assembly disposed for receiving said pin guide and being positioned to accommodate rotation of said pin guide when said shaft is rotated about its longitudinal axis.

64. A multi-purpose tool as set forth in claim 61 wherein said keyway has a transverse duct disposed for receiving said pin guide when said shaft end is in its first position, said transverse duct thereby permitting limited rotation of the shaft with respect to said cylinder assembly to assure positive engagement of the working tip to the shaft end.

65. A multi-purpose tool with a safety barrel comprising:

a plurality of working tips;

a cylinder assembly having a plurality of chambers for housing said plurality of working tips;

a shaft engaging said cylinder assembly in longitudinal sliding engagement, said shaft movable between a first position and a second position;

a safety barrel connected to said cylinder assembly and aligned with said shaft such that said shaft slides into said safety barrel as said shaft moves from its first position into its second position;

means for coupling one of the working tips to said shaft when said shaft is in its first position and the working tip is housed within one of the chambers, the working tip coupled to said shaft being advanced to a working position as said shaft is slidably moved from its first position into said safety barrel to its second position;

means for permitting rotation of said shaft and the working tip coupled thereto independently of said safety barrel, and for permitting rotation of said safety barrel independently of said shaft, when said shaft is in its second position, whereby a user of the multi-purpose tool can grasp said safety barrel and stabilize the tool during use without having said shaft rotating in the user's hand; and means for locking said shaft to prevent rotation thereof independent of said safety barrel except when said shaft is in its second position.

66. A multi-purpose tool with safety barrel as set forth in claim 65 wherein said safety barrel is elongated and extends from said cylinder assembly to a point proximate to the working end of the working tip when said shaft is in its second position, such that the user can grasp the safety barrel near the working end of the working tip without having the working tip rotate in the user's hand.

67. A multi-purpose tool with safety barrel as set forth in claim 65 wherein the axis for rotation of said cylinder is substantially parallel to and offset from the longitudinal axis of said shaft and the longitudinal axis of said safety barrel is substantially the same as the longitudinal axis of said shaft.

68. A multi-purpose tool with safety barrel as set forth in claim 65 wherein said shaft has a power tool attachment end for attachment to a power tool and a distal end for engaging said cylinder assembly in longitudinal sliding engagement.

* * * * *

UNITED STATES PATENT AND TRADEMARK OFFICE

CERTIFICATE OF CORRECTION

PATENT NO. : 4,572,038

DATED : February 25, 1986

INVENTOR(S) : Charles H. Graham

It is certified that error appears in the above-identified patent and that said Letters Patent is hereby corrected as shown below:

Column 2, line 11, "strip" should be --tips--
Column 3, line 57, "screw driver" should be --screwdriver--
Column 4, line 26, "enlarge" should be --enlarged--
Column 5, line 19, "screw driver" should be --screwdriver--
Column 5, line 19, "Phillips screw driver" should be --Phillips screwdriver--
Column 5, line 23, "screw driver ends" should be --screwdriver ends--
Column 7, line 26, "screw driver" should be --screwdriver--
Column 7, line 63, "channel 60," should be --channel 60, and--
Column 9, line 31, "desired" should be --desires--
Column 12, line 20, "work piece" should be --workpiece--
Column 12, line 38, "work piece" should be --workpiece--
Column 12, line 41, "work piece" should be --workpiece--
Column 12, line 47, "slideable" should be --slidable--
Column 13, lines 24-25, "work piece" should be --workpiece--
Column 14, line 14, "chambers;" should be --chambers,--
Column 14, line 50, "and arcuate groove" should be --an arcuate groove--
Column 15, line 38, "pl" should be deleted
Column 15, line 38, "a shaft having" should be preceded by a new subparagraph
Column 15, line 47, "chamber;" should be --chamber,--

Signed and Sealed this

*Nineteenth* Day of *August 1986*

[SEAL]

*Attest:*

DONALD J. QUIGG

*Attesting Officer*

*Commissioner of Patents and Trademarks*